US007172190B2

(12) United States Patent
Park

(10) Patent No.: US 7,172,190 B2
(45) Date of Patent: Feb. 6, 2007

(54) PAPER FEEDING MECHANISM FOR AN INKJET PRINTER AND METHOD FOR USING THE SAME

(75) Inventor: Jin-ho Park, Youngin (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 303 days.

(21) Appl. No.: 10/455,422

(22) Filed: Jun. 6, 2003

(65) Prior Publication Data

US 2004/0032074 A1 Feb. 19, 2004

(30) Foreign Application Priority Data

Aug. 16, 2002 (JP) ..... 2002-48543

(51) Int. Cl.
*B65H 5/00* (2006.01)

(52) U.S. Cl. ..... 271/10.13; 271/10.12; 271/10.04

(58) Field of Classification Search ..... 271/10.13, 271/10.12, 10.04, 4.04, 3.14, 4.01, 4.08, 271/4.09, 10.01, 109, 114, 113; 74/353, 74/354

See application file for complete search history.

(56) References Cited

U.S. PATENT DOCUMENTS 4,721,297 A * 1/1988 Katayama ..... 271/10.04
5,854,696 A * 12/1998 Yun ..... 358/498
5,947,465 A * 9/1999 Kato et al. ..... 271/10.11
6,641,130 B2 * 11/2003 Lee et al. ..... 271/10.04

FOREIGN PATENT DOCUMENTS

JP 05092838 A * 4/1993
JP 05092839 A * 4/1993

* cited by examiner

*Primary Examiner*—Donald P. Walsh
*Assistant Examiner*—Kaitlin Joerger
(74) *Attorney, Agent, or Firm*—Roylances Abrams Berdo & Goodman LLP

(57) ABSTRACT

A paper feeding mechanism for an inkjet printer having a rapid printing speed and which continuously supplies and discharges sheets of paper during alignment operations of the feed roller. The paper feeding mechanism includes a drive gear coaxially coupled to a shaft of drive roller for transferring a sheet to a printing zone, a feed gear coaxially coupled to a shaft of the feed roller and operating to align the sheet transferred from the drive roller, and a discharge gear coaxially coupled to a shaft of discharge roller for discharging the sheet that has passed through the printing zone. The paper feeding mechanism further includes a motor for supplying a rotation power to the shaft of the feed roller, and a power transfer unit for transferring the rotation power of the shaft of the feed roller to the drive gear and the discharge gear. The power transfer unit includes a swing gear clutch installed between the feed gear and the drive gear, and a rotation power transfer device for connecting the drive gear and the discharge gear, such that a direction of rotation of the drive gear is constantly maintained by the swing gear clutch in a direction for transferring the sheet to the printing zone even though a direction of rotation of the feed gear changes and the discharge gear rotates in the same direction as the drive gear.

27 Claims, 5 Drawing Sheets

PAPER FEEDING MECHANISM FOR AN INKJET PRINTER AND METHOD FOR USING THE SAME

This application claims benefit under 35 U.S.C. § 119 from Korean Patent Application No. 2002-48543, filed on Aug. 16, 2002, the entire content of which is incorporated herein by reference.

BACKGROUND OF THE INVENTION

1. Field of the Invention

The present invention relates to an inkjet printer, and more particularly, to a paper feeding mechanism for transferring sheets of paper to an inkjet printer for printing, and a method for using the same.

2. Description of the Related Art

As can be appreciated by one skilled in the art, to perform a printing operation, an inkjet printer transfers a sheet to a printing zone, ejects ink on the sheet via a print head in which ink cartridges are mounted to print characters or images, and discharges a printed sheet out of the main body of the printer. A conventional inkjet printer of this type includes a paper supply cassette, a pickup roller, a drive roller, a feed roller, a discharge roller, and a print head.

The paper supply cassette stores sheets of paper, and the pickup roller is disposed to rotate while contacting the upper surface of a topmost sheet loaded in the paper supply cassette. The drive roller is located in the middle of a paper transfer path connecting the leading edge of the paper supply cassette and the feed roller, and transfers to the feed roller a sheet picked up by the pickup roller.

The feed roller is located ahead of the print head, and, in conjunction with a print head guide bar, aligns the sheet transferred from the drive roller so as to cause the leading edge of that sheet to be supplied in parallel with the travel direction of the print head. The feed roller thus positions the aligned sheet beneath the printing head.

The print head ejects ink through nozzles while traversing along the guide bar that is parallel with the feed roller, thereby printing characters and images on the sheet. The discharge roller is mounted in the paper travel path past the print head, and discharges the sheet after the printing has been completed by the print head.

An inkjet printer having the above structure operates as follows.

If the pickup roller rotates, the topmost sheet of the stack of sheets loaded in the paper supply cassette is separated and transferred to the drive roller. The drive roller transfers to the feed roller the sheet picked up by the pickup roller. The feed roller aligns the sheet to enable the sheet transferred from the drive roller to be supplied in parallel with the guide bar. At this time, a technique for aligning the printing sheet employs a general technique in which the feed roller reverse-rotates to backwards transfer the printing sheet toward the drive roller by a certain distance, and then forward-rotates.

In order to align a printing sheet in such a manner, the feed roller needs to perform reverse and forward rotations. However, the drive roller or the discharge roller needs only to perform only a unidirectional rotation. Accordingly, these types of printers typically employ a driving source for the feed roller and a separate driving source for the drive roller, or alternatively, employ a clutch to interrupt power transferred to the drive roller as needed to enable the feed roller to reverse-rotate and forward-rotate as necessary. In this configuration, the discharge roller is generally mounted to be driven in association with the driving source for the feed roller.

However, an inkjet printer that uses a clutch to interrupt the drive roller has the following problems.

First, when the feed roller aligns a sheet for printing, the drive roller can not transfer a picked-up sheet to the feed roller because rotation of the drive roller is stopped when the feed roller is reverse-rotated during the aligning operation.

Second, before the distal end of a sheet completely comes out of the discharge roller when being discharged from the printer after being printed on, the feed roller cannot align the sheet transferred from the drive roller because the sheet being discharged is reverse-transferred toward the feed roller when the discharge roller is reverse-rotated as the feed roller is reverse-rotated.

Third, sheets of paper cannot be continuously supplied. In order to continuously supply sheets, when the end of a sheet picked up by the pickup roller passes through the drive roller, the pickup roller should pick up a new sheet and then pass the newly picked-up sheet to the drive roller. However, when the distal end of the previous sheet passes through the drive roller and the leading edge of the new sheet passes into the feed roller, the drive roller is in a stopped state during the time that the feed roller reverse rotates to align the sheet. Accordingly, sheets are not supplied continuously, and the inkjet printer experiences a low printing speed, in other words, a low number of printed sheets per minute.

Furthermore, although the first and third problems discussed above do not occur when a separate driving source drives the drive roller, the problem of low printing speed still remains. In addition, the use of a separate driving source raises the manufacturing cost of the printer, and requires more space for installing the additional driving source, which increases the overall size of the printer.

SUMMARY OF THE INVENTION

It is therefore an object of the present invention to provide a paper feeding mechanism for an inkjet printer which enables the drive roller and discharge roller of the printer to continuously rotate in one direction even though feed roller changes its rotational direction, to thereby enhance a printing speed.

Another object of the present invention is to provide a paper feeding mechanism for an inkjet printer with less manufacturing cost and higher printing speed.

In order to substantially achieve the above objects, a paper feeding mechanism for an inkjet printer according to an embodiment of the present invention comprises a drive gear coaxially coupled to a shaft of a drive roller for transferring a sheet of paper to a printing zone, a feed gear coaxially coupled to a shaft of a feed roller for aligning the printing sheet transferred from the drive roller, and a discharge gear coaxially coupled to a shaft of discharge roller for discharging the printing sheet that has passed through the printing zone. The printer further comprises a motor for supplying rotation power to the shaft of the feed roller, and a power transfer unit for transferring rotation power of the shaft of the feed roller to the drive gear and the discharge gear.

In this embodiment, the drive roller and the discharge roller constantly rotate in one direction even through a direction of rotation of the motor changes. Furthermore, the power transfer unit includes a swing gear clutch installed between the feed gear and the drive gear, and a rotation power transfer device for connecting the drive gear and the discharge gear. A direction of rotation of the drive gear is constantly maintained by the swing gear clutch in a direction that transfers the sheet to the printing zone even though a direction of the feed gear changes, and the discharge gear rotates in the same direction as the drive gear.

In addition, the swing gear clutch includes a swing gear meshed with the feed gear, a swing arm having a first arm and a second arm and installed to a shaft of the swing gear, a first swing gear train coupled to the first arm for transferring rotation power in the same direction as a direction of rotation of the feed gear, and a second swing gear train coupled to the second arm for transferring rotation power in a direction reverse to a direction of rotation of the feed gear. The swing arm revolves about the shaft of the swing gear based on a direction of rotation of the feed gear to selectively utilize either the first swing gear train or the second swing gear train to transfer rotational power to the drive gear. The power transfer unit may include a rotation power transfer device for transferring rotational power from the drive gear to the discharge gear.

Although in this exemplary embodiment, the power transfer unit comprises a swing gear placed between the feed gear and the drive gear, it should be readily apparent to those skilled in the art that the swing gear may alternatively be placed between the feed gear and the discharge gear.

The first swing gear train can be comprised of one gear, and the second swing gear train can be comprised of two gears. Furthermore, the rotation power transfer device in this example includes a first pulley coaxially coupled to the drive gear, a second pulley coaxially coupled to the discharge gear, and a belt connecting the first and second pulleys, and it is preferable in this example that the first and second pulleys are timing pulleys, respectively.

In addition, the power transfer unit in this example includes a first middle gear meshed with the drive gear, a swing gear clutch coupled between the feed gear and the first middle gear, a second middle gear meshed with the discharge gear, and a rotation power transfer device for transferring the rotational power of the first middle gear to the second middle gear.

Furthermore, a paper feeding mechanism for an inkjet printer according to an embodiment of the present invention comprises a motor, a first gear for being rotated by the motor, a second gear, and a third gear. A swing gear clutch is installed between the first gear and the second gear for rotating the second gear in a constant direction even though the direction of the rotation of the first gear changes, and a rotation power transfer device for transferring rotation power of the second gear to the third gear.

In this example, the swing gear clutch includes a swing gear meshed with the first gear, a swing arm having a first arm and a second arm and coupled to a shaft of the swing gear, a first swing gear train coupled to the first arm and for transferring a rotation power in the same direction as a direction of rotation of the first gear, and a second swing gear train coupled to the second arm for transferring rotation power in a direction reverse to a direction of rotation of the second gear. The swing arm revolves about the shaft of the swing gear based on a rotation direction of the first gear to selectively utilize either the first swing gear train or the second swing gear train to rotate the second gear.

Furthermore, the rotation power transfer device includes a first pulley coaxially coupled to the second gear, a second pulley coaxially coupled to the third gear, and a belt for connecting the first and second pulleys. In this example, it is preferable that the first and second pulleys are timing pulleys, respectively.

A paper feeding mechanism for an inkjet printer according to another embodiment of the present invention comprises a motor, a first gear for being rotated by the motor; a second gear, a first middle gear meshed with the second gear, a third gear, and a second middle gear meshed with the third gear. The printer further comprises a swing gear clutch installed between the first gear and the first middle gear for rotating the first middle gear in a constant direction even though the direction of the rotation of the first gear changes, and a rotation power transfer device for transferring rotation power of the first middle gear to the second middle gear.

During operation of the swing gear clutch, the swing arm revolves about the shaft of the swing gear based on a direction of rotation of the first gear to selectively utilize either the first swing gear train or the second swing gear train to the first middle gear to rotate the second gear. Furthermore, the rotation power transfer device includes a first pulley coaxially coupled to the first middle gear, a second pulley coaxially coupled to the second middle gear, and a belt for connecting the first and second pulleys.

As stated above, in the paper feeding mechanism for an inkjet printer according to an embodiment the present invention, the drive roller and the discharge roller continuously rotate in one direction for supplying sheets for printing, thereby enabling the supply and discharge of sheets even when the feed roller operates to align the sheets. Accordingly, the paper feeding mechanism for an inkjet printer with enhanced printing speed is provided. Furthermore, the above objects can be achieved without requiring separate driving sources, which thus provides a paper feeding mechanism for an inkjet printer that is lower in manufacturing cost than a conventional printer, and has smaller size and an enhanced printing speed.

BRIEF DESCRIPTION OF THE DRAWINGS

The above objects and other features of the present invention will become more apparent by describing in detail a preferred embodiment thereof with reference to the attached drawings, in which.

DETAILED DESCRIPTION OF THE PREFERRED EMBODIMENTS

A paper feeding mechanism for an inkjet printer according to several embodiments of the present invention will now be described with respect to the attached drawings.

Figure 1:
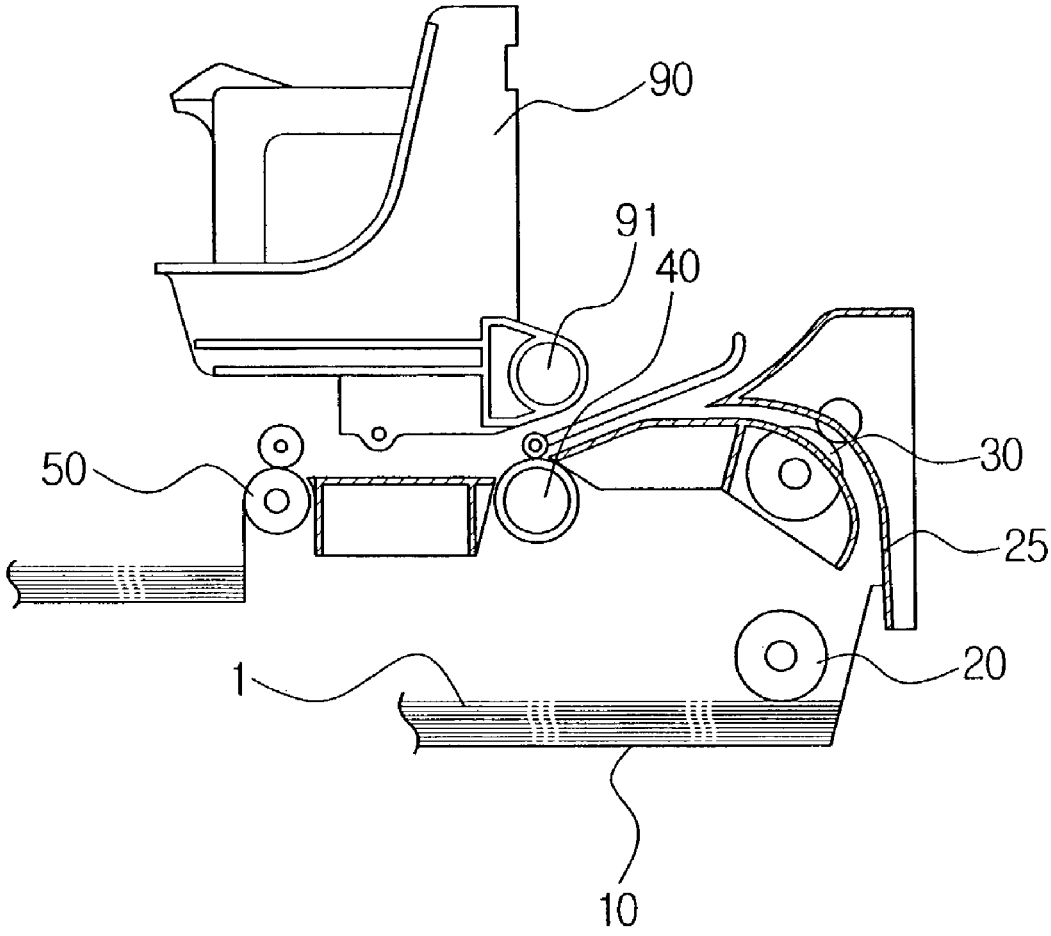
FIG. 1 (PRIOR ART)
FIG. 1 is a conceptual view of a structure of a conventional inkjet printer.

Referring to FIG. 1, an inkjet printer includes a paper supply cassette 10, a pickup roller 20, a drive roller 30, feed roller 40, a discharge roller 50, and a print head 90. The paper supply cassette 10 stores a plurality of sheets of paper 1, and the pickup roller 20 is mounted to rotate while pressing the top surface of a topmost sheet of the sheets 1 loaded in the paper supply cassette 10. The drive roller 30 is mounted in the middle of a paper transfer path 25 connecting the leading edge of the paper supply cassette 10 and the feed roller 40, and transfer a sheet picked up by the pickup roller 20 to the feed roller 40.

The feed roller 40 is mounted in the paper travel path before the print head 90, to align the leading edge of the sheet transferred from the drive roller 30 to be in parallel with the guide bar 91. The feed roller 40 thus places the aligned sheet at a certain location beneath the print head 90. The print head 90 ejects ink through nozzles while traversing along the guide bar 91, which is parallel with the feed roller 40, to thereby print characters or images on the sheet. The discharge roller 50 is mounted in the paper travel path past the print head 90, and discharges a sheet on which printing has been completed by the print head 90 out of the printer.

Figure 2:
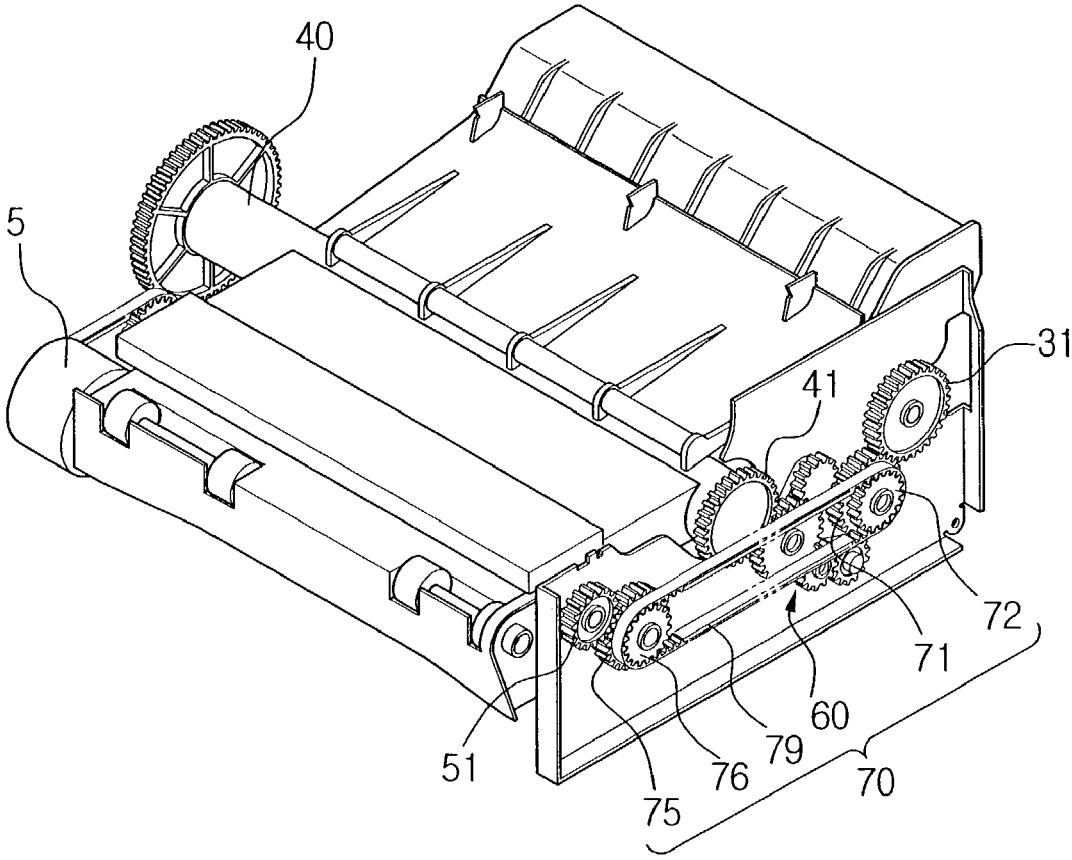
FIG. 2 is a perspective view showing a paper feeding portion including a piper feeding mechanism according to an embodiment of the present invention.
Figure 3:
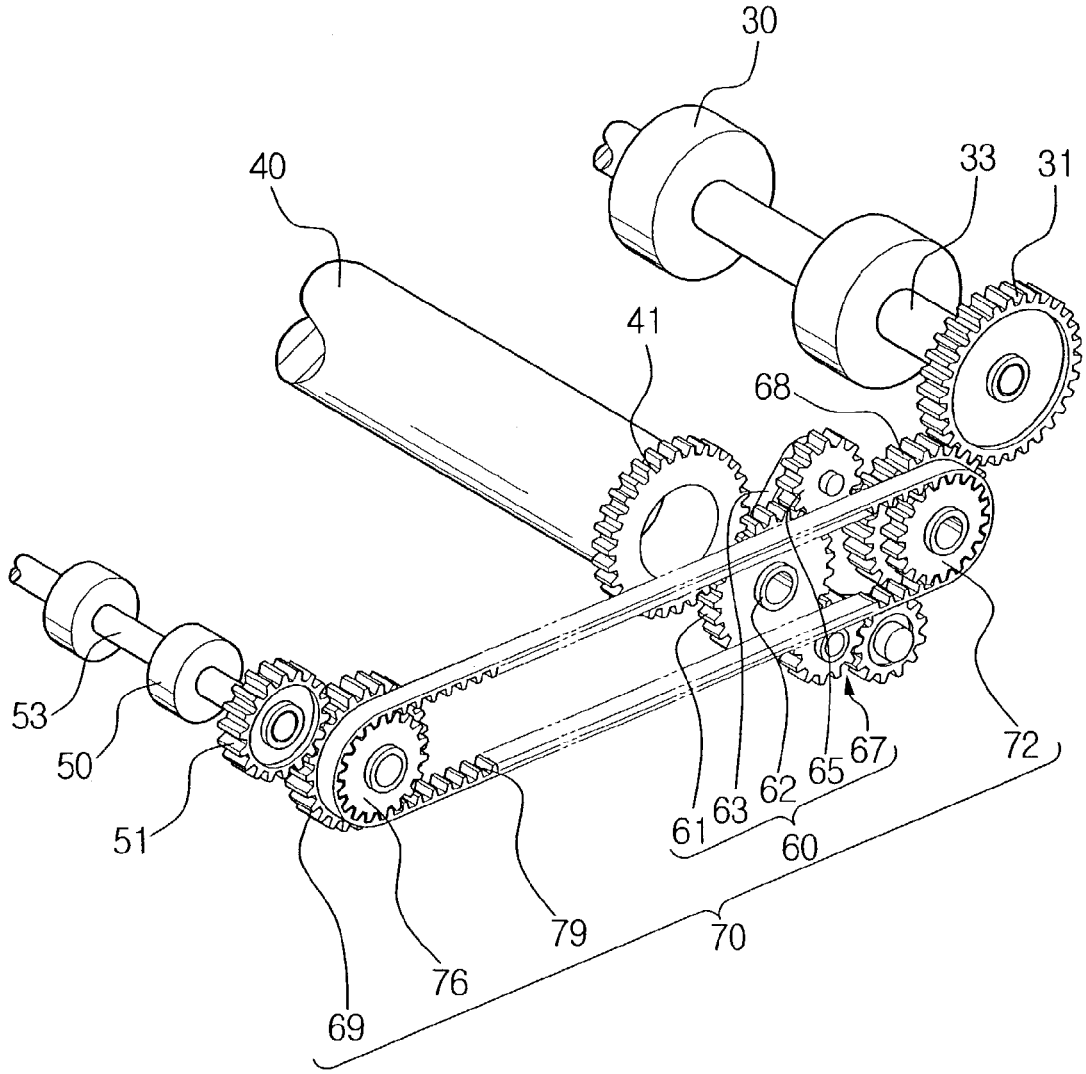
FIG. 3 is a partial perspective view showing an example of the relationship between respective parts of the paper feeding mechanism shown in FIG. 2.
Figure 4:
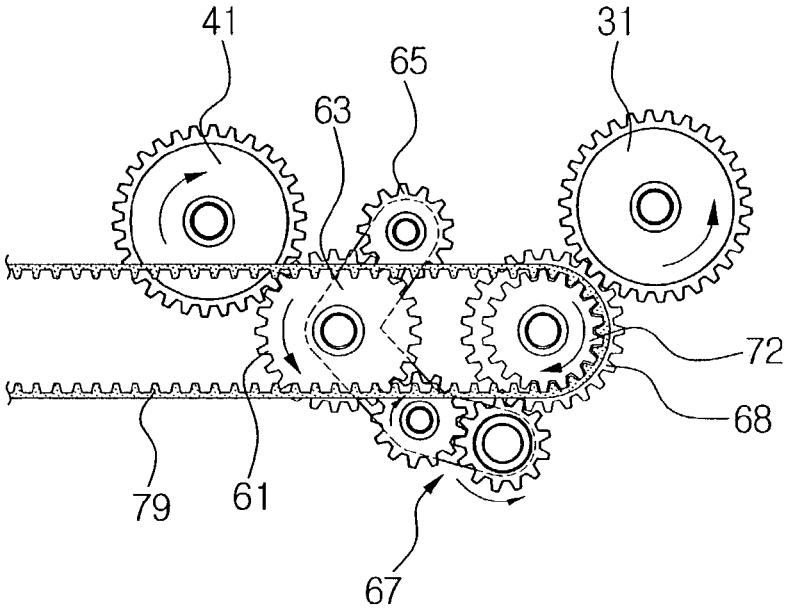
FIG. 4 illustrates an example of a power transfer relationship that occurs when the feeding gear in the paper feeding mechanism shown in FIG. 2 rotates clockwise.
Figure 5:
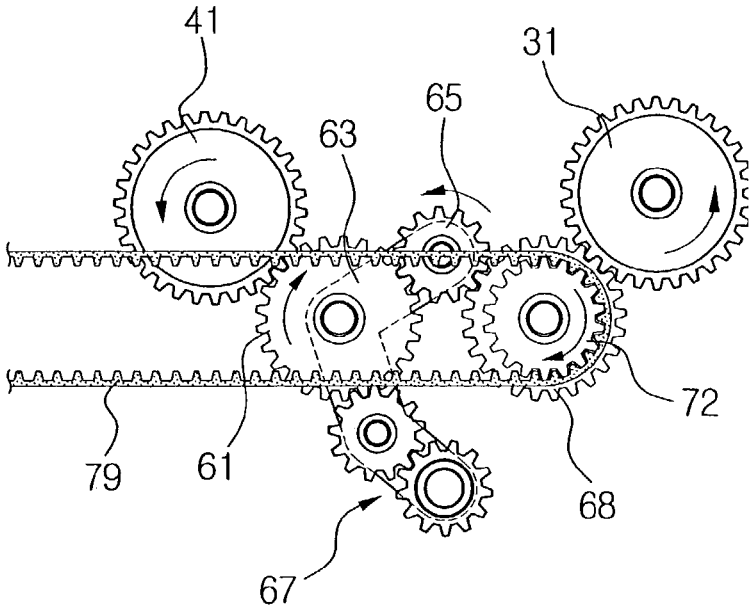
FIG. 5 illustrates and example of a power transfer relationship that occurs when the feed gear in the paper feeding mechanism shown in FIG. 2 rotates counterclockwise.

FIG. 2 and FIG. 3 show an example of a paper feeding mechanism for an inkjet printer having the above structure according to an embodiment of the present invention.

Referring to FIG. 2 and FIG. 3, the paper feeding mechanism includes a drive gear 31, a feed gear 41, a discharge gear 51, and a power transfer unit 70. The drive gear 31 is coaxially coupled to the shaft 33 of the drive roller 30, and the discharge gear 51 is coaxially coupled to the shaft 53 of the discharge roller 50. The feed gear 41 is coaxially coupled to the shaft of the feed roller 40 to receive power firm a motor 5 which is a driving source.

The power transfer unit 70 has a first middle gear 68 meshed with the drive gear 31, a swing gear clutch 60 installed between the feed gear 41 and the first middle gear 68, a second middle gear 69 meshed with the discharge gear 51, and a rotation power transfer device connecting the first middle gear 68 and the second middle gear 69.

The swing gear clutch 60 includes a swing gear 61 and the swing arm 63. The swing gear 61 is installed to be meshed with the feed gear 41. The swing arm 63 has two arms, that is, a first arm and a second arm which are molded into a L-shape. A first swing gear train 65 is installed to the first arm of the swing arm 63, and a second swing gear train 67 is coupled to the second arm. Furthermore, the swing arm 63 is coupled to the shaft 62 of the swing gear in order for the first swing gear train 65 or the second swing gear train 67 to be selectively coupled to the first middle gear 68 based on a rotation direction of the swing gear 61. Accordingly, as the swing gear 61 rotates based on a rotation direction of the feed gear 41, the swing arm 63 revolves about the shaft 62 of the swing gear in the rotation direction of the swing gear 61 so that either the first swing gear train 65 or the second swing gear train 67 is coupled to the first middle gear 68 to enable power transfer.

In this example, the first swing gear train 65 is composed of an odd number of gears to enable rotation power to be transferred in the same direction as a rotation direction of the feed gear 41. Furthermore, the second swing gear train 67 is composed of an even number of gears in order for rotation power to be transferred in a direction reverse to a rotation direction of the feed gear 41. In this embodiment, the first swing gear train 65 is composed of one gear, the second swing gear train 67 is composed of two gears.

Furthermore, the rotation power transfer device is constructed to transfer the rotation of the first middle gear 68 to the second middle gear 69 without a direction change. The embodiment includes a pulley 72 that is coaxially coupled with the first middle gear 68, a pulley 76 that is coaxially coupled with the second middle gear 69, and a belt 79 connecting both pulleys 72 and 76. In this example, it is preferable to employ timing pulleys and a timing belt for both pulleys 72 and 76 and the belt 79, respectively.

The following describes an example of the operations of the paper feeding mechanism of an inkjet printer having the structure discussed above, with reference to FIG. 1 to FIG. 5.

When a printing sheet 1 is picked up by the pickup roller 20, the feed roller 40 is rotated counterclockwise by the motor 5. If the feed roller 40 rotates counterclockwise, the feed gear 41 coaxially coupled to the feed roller 40 also rotates counterclockwise. If the feed gear 41 rotates counterclockwise, the swing gear 61 rotates clockwise. Accordingly, the swing arm 63 that is coaxially installed with the swing gear 61 revolves in a clockwise direction so the first swing gear train 65 is couples with the first middle gear 68. As discussed above, the first swing gear train 65 in this example is composed of one gear, so the first middle gear 68 rotates clockwise as does the swing gear 61. When the first middle gear 68 rotates clockwise, the drive gear 31 that is meshed with the first middle gear 68 rotates counterclockwise. When the drive gear 31 rotates counterclockwise, the drive roller 30 rotates counterclockwise to transfer a sheet from the pickup roller 50 toward the feed roller 40.

When the leading edge of the sheet is moved into the feed roller 40 by the drive roller 30, the feed roller 40 starts to reverse rotate to align the sheet. When the feed roller 40 reverse-rotates, the feed gear 41 that is coaxially coupled to the shaft of the feed roller 40 rotates clockwise. When the feed gear 41 rotates clockwise, the swing gear 61 rotates counterclockwise. When the swing gear 61 rotates counterclockwise, the swing arm 63 revolves counterclockwise to couple the second swing gear train 67 with the first middle gear 68. In this example, the second swing ear train 67 is composed of two gears, so that the first middle gear 68 rotates clockwise in the reverse direction to the swing gear 61. When the first middle gear 68 rotates clockwise, the drive gear 31 meshed with the swing gear rotates counterclockwise. When the drive gear 31 rotates counterclockwise, the drive roller 30 rotates counterclockwise to move a printing sheet transferred from the pickup roller toward the feed roller 40. That is, the drive roller 30 continuously supplies a sheet toward the feed roller 40 even though the rotation direction of the feed roller 40 changes. Accordingly, when the feed roller 40 aligns a printing sheet, the pickup roller continues to pick up a sheet, so that the continuous supply of sheets becomes possible.

The feed roller 40 rotates clockwise for a predetermined number of times, and then rotates counterclockwise to thereby place a printing sheet below the print head 90.

A printing sheet that passes through the feed roller 40 is transferred toward the discharge roller 50. At this time, the rotation directions of the discharge roller 50 are as follows. The discharge gear 51 is coaxially coupled to the shaft 53 of the discharge roller, and the discharge gear 51 is meshed with the second middle gear 69. Furthermore, the second middle gear 69 is connected to the first middle gear 68, the timing belt 79, and the pulleys 72 and 76. Therefore, the discharge gear 51 rotates in a reverse direction with respect to the first middle gear 68. That is, the discharge gear 51 rotates in the same direction as the drive gear 31 that is meshed with the first middle gear 68.

However, as described above, the drive gear 31 rotates counterclockwise constantly regardless of the rotation directions of the feed gear 41, so the discharge gear 51 constantly rotates counterclockwise regardless of the rotation directions of the feed gear 41. That is, the discharge roller 50 that is coaxially coupled with the discharge gear 51 rotates counterclockwise regardless of the rotation directions of the feed roller 40.

Accordingly, even when the feed roller 40 reverse-rotates to align a sheet before the discharge roller 50 discharges a sheet on which printing has been completed, the discharge roller 50 continues to rotate counterclockwise, to thereby constantly discharge the sheets on which printing has occurred.

As can be appreciated from the above, the embodiment of the present invention described with regard to FIGS. 1–5 employs a swing gear clutch that is installed between the feed gear and the first middle gear. Alternatively, the swing gear clutch can be installed between the feed gear 41 and the second middle gear 69. In this arrangement, the power transfer process is the same as that described above. Therefore, to avoid redundancy, a detailed description of this process is will not be repeated here.

Figure 6:
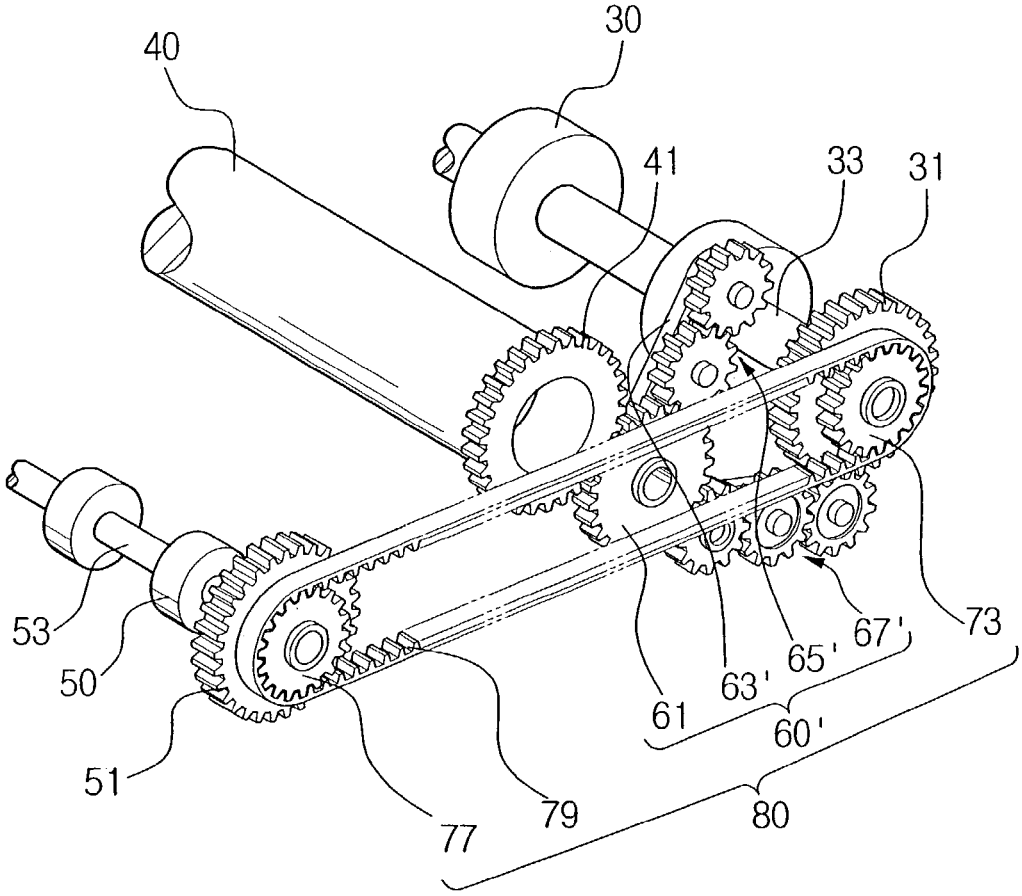
FIG. 6 is a partial perspective view showing an example of a paper feeding mechanism according to another embodiment of the present invention.

FIG. 6 shows a paper feeding mechanism for an inkjet printer according to another embodiment of the present invention. As can be appreciated from FIG. 6 and the following description, this embodiment is different from the embodiment described above, because it does not include the two middle gears 68 and 69.

Referring to FIG. 6, the paper feeding mechanism includes a drive gear 31, a feed gear 41, a discharge gear 51, and a power transfer unit 80. The drive gear 31 is coaxially coupled to the shaft 33 of the drive roller, and the discharge gear 51 is coaxially coupled to the shaft 53 of the discharge roller. The feed gear 41 is coaxially coupled to the shaft of the feed roller 40 receiving power from the motor 5 (refer to FIG. 1) which is a driving source.

The power transfer unit 80 includes a swing gear clutch 60' installed between the feed gear 41 and the drive gear 31, and a rotation power transfer device connecting the drive gear 31 and the discharge gear 51. The swing gear clutch 60' has a swing gear 61 and a swing arm 63'. The swing gear 61 is installed to be meshed with the feed gear 41. The swing arm 63' has two arms, namely, a first arm and a second arm, molded in a shape surrounding the drive gear 31. A first swing gear train 65' is mounted to the first arm of the swing arm 63', and a second swing gear train 67' is mounted to the second arm. Also, the swing arm 63' is mounted to the shaft 62 of the swing gear in order for either the first swing gear train 65' or the second swing gear train 67' to be selectively connected to the drive gear 31 based on a rotation direction of the swing gear 61. Therefore, when the swing gear 61 rotates based on a rotation direction of the feed gear 41, the swing arm 63' revolves about the shaft 62 of the swing gear in the rotation direction of the swing gear 61 to connect either the first swing gear train 65' or the second swing gear train 67' to the drive gear 31, to thereby transfer power.

In this example, the first swing gear train 65' comprises an even number of gears to transfer rotation power in the same direction as the rotation direction of the feed gear 41. The second swing gear train 67' comprises odd number of gears to transfer rotation power in a reverse direction to the rotation direction of the feed gear 41. In this embodiment, the first swing gear train 65' comprises two gears, and the second swing gear train 67' comprises three gears.

It is noted that the rotation power transfer device is constructed to transfer the rotations of the drive gear 31 without direction changes. The present embodiment further includes a pulley 73 that is coaxially coupled to the drive gear 31, a pulley 77 that is coaxially coupled to the discharge gear 51, and a belt 79 that connects the both pulleys 73 and 77. In this example, it is preferable to employ timing pulleys and a timing belt for both pulleys 73 and 77 and the belt 79.

An example of the operations of the paper feeding mechanism for an inkjet printer having the structure discussed above will now be described with reference to FIG. 6.

When a sheet 1 is picked up by the pickup roller 20 (refer to FIG. 1), the feed roller 40 is rotated counterclockwise by the motor. When the feed roller 40 rotates counterclockwise, the feed gear 41 coaxially coupled to the roller 40 also rotates counterclockwise. When the feed gear 41 rotates counterclockwise, the swing gear 61 rotates clockwise. Therefore, the swing arm 63' that is coaxially coupled to the swing gear 61 revolves clockwise to connect the first swing gear train 65' to the drive gear 31. In this example, the first swing gear train 65' comprises an even number of gears, so the drive gear 31 rotates counterclockwise in a direction reverse to the direction of movement of the swing gear. When the drive gear 31 rotates counterclockwise, the drive roller 30 rotates counterclockwise to transfer toward the feed roller 40 a sheet moved by the pickup roller 20.

When the drive roller 30 passes the leading edge of a sheet into the feed roller 40, the feed roller 40 starts a reverse rotation to align the printing sheet. When the feed roller 40 reverse-rotates, the feed gear 41 coaxially coupled to the shaft of the feed roller 40 rotates clockwise. When the feed gear 41 rotates clockwise, the swing gear 61 rotates counterclockwise. When the swing gear 61 rotates counterclockwise, the swing arm 63' revolves counterclockwise to connect the second swing gear train 67' to the drive gear 31. In this example, the second swing gear train 67' comprises an odd number of gears so that the drive gear 31 rotates counterclockwise when the swing gear 61 rotates counterclockwise. When the drive gear 31 rotates counterclockwise, the drive roller 30 rotates counterclockwise to move a sheet transferred from the pickup roller 20 toward the feed roller 40. That is, the drive roller 30 continues to supply a sheet toward the feed roller 40 even through the rotation direction of the feed roller 40 changes.

The feed roller 40 rotates clockwise the predetermined number of times and then rotates counterclockwise, to thereby place a sheet below the print head 90 (refer to FIG. 1). A sheet that has passed through the feed roller 40 is transferred toward the discharge roller 50. The rotation direction of the discharge roller 50 is as follows. The discharge gear 51 is coaxially coupled to the shaft 53 of the discharge roller 50, and the discharge gear 51 is connected to the drive gear 31, the timing belt 79 and pulleys 72 and 76. Therefore, the discharge gear 51 rotates in the same direction as the drive gear 31.

However, as stated above, the drive gear 31 rotates constantly and counterclockwise regardless of the rotation direction of the feed gear 41, so that the discharge gear 51 rotates constantly and counterclockwise regardless of the rotation direction of the feed gear 41. That is, the discharge roller 50 coaxially coupled to the discharge gear 51 rotates counterclockwise regardless of the rotation direction of the feed roller 40. Accordingly, the discharge roller 50 continues to rotate counterclockwise when the feed roller 40 reverse-rotates, to align a printing sheet before the discharge roller 50 finishes discharging a sheet on which printing has been completed, so that the sheet is discharged accordingly.

As can be appreciated from the above, FIG. 6 illustrates an example where the swing gear clutch is installed between the feed gear and the drive gear. However, the swing gear clutch can be installed between the feed gear and the discharge gear, in which event the power transfer process is the same as described above.

Although several embodiments of the present invention have been described, it will be understood by those skilled in the art that the present invention should not be limited to the embodiments described above, but that various changes and modifications can be made within the spirit and scope of the embodiments of the present invention as defined by the appended claims.

What is claimed is:

1. A paper feeding mechanism for an inkjet printer, comprising:

a drive gear, coaxially coupled to a shaft of a drive roller and adapted to transfer a sheet of paper to a printing zone;

a feed gear, coaxially coupled to a shaft of a feed roller and adapted to align the sheet transferred from the drive roller;

a discharge gear, coaxially coupled to a shaft of a discharge roller and adapted to discharge the sheet after the sheet has passed through the printing zone;

a motor, adapted to supply rotation power to the shaft of the feed roller; and a power transfer unit, adapted to transfer a rotation power of the shaft of the feed roller to the drive gear and the discharge gear such that the drive gear and the discharge gear rotate in a constant direction regardless of a direction in which the feed gear rotates, the power transfer unit comprising:

a swing gear clutch installed between the feed gear and the drive gear for causing a rotation direction of the drive gear to be constantly maintained in a direction that is adapted to transfer the sheet to the printing zone even though a direction of rotation of the feed gear changes; and a rotation power transfer device, adapted to couple the drive gear to the discharge gear for causing the discharge gear to rotate in the same direction as the drive gear.

2. The paper feeding mechanism as claimed in claim 1, wherein the swing gear clutch includes:

a swing gear meshed with the feed gear;

a swing arm having a first arm and a second arm, and coupled to a shaft of the swing gear;

a first swing gear train coupled to the first arm, said first swing gear train being adapted to transfer a rotation power in the same direction as a direction of rotation of the feed gear; and a second swing gear train coupled to the second arm, said second swing gear train being adapted to transfer a rotation power in a direction reverse to a direction of rotation of the feed gear, such that the swing arm revolves about the shaft of the swing gear in accordance with a direction of rotation of the feed gear to selectively utilize one of the first swing gear train and the second swing gear train to rotate the drive gear.

3. A paper feeding mechanism for an inkjet printer, comprising:

a drive gear, coaxially coupled to a shaft of a drive roller and adapted to transfer a sheet of paper to a printing zone;

a feed gear, coaxially coupled to a shaft of a feed roller and adapted to align the sheet transferred from the drive roller;

a discharge gear, coaxially coupled to a shaft of a discharge roller and adapted to discharge the sheet after the sheet has passed through the printing zone;

a motor, adapted to supply rotation power to the shaft of the feed roller; and a power transfer unit, adapted to transfer a rotation power of the shaft of the feed roller to the drive gear and the discharge gear such that the drive gear and the discharge gear rotate in a constant direction regardless of a direction in which the feed gear rotates, the power transfer unit comprising:

a swing gear clutch coupled between the feed gear and the discharge gear for causing a direction of rotation of the discharge gear to be constantly maintained in a direction that is adapted to discharge the printing sheet even though a direction of rotation of the feed gear changes; and a rotation power transfer device, adapted to connect the drive gear and the discharge gear for causing the drive gear to rotate in the same direction as the discharge gear.

4. The paper feeding mechanism as claimed in claim 3, wherein the swing gear clutch includes:

a swing gear meshed with the feed gear;

a swing arm having a first arm and a second arm, and coupled to a shaft of the swing gear;

a first swing gear train coupled to the first arm, said first swing gear train being adapted to transfer a rotation power in the same direction as a direction of rotation of the feed gear; and a second swing gear train coupled to the second arm, said second swing gear train being adapted to transfer a rotation power in a direction reverse to a direction of rotation of the feed gear, such that the swing arm revolves about the shaft of the swing gear based on a direction of rotation of the feed gear to selectively utilize one of the first swing gear train and the second swing gear train to rotate the discharge gear.

5. The paper feeding mechanism as claimed in claim 2, wherein the first swing gear train comprises an odd number of gears.

6. The paper feeding mechanism as claimed in claim 4, wherein the first swing gear train comprises an odd number of gears.

7. The paper feeding mechanism as claimed in claim 2, wherein the second swing gear train comprises an even number of gears.

8. The paper feeding mechanism as claimed in claim 4, wherein the second swing gear train comprises an even number of gears.

9. The paper feeding mechanism as claimed in claim 1, wherein the rotation power transfer device includes:

a first pulley coaxially coupled to the drive gear;

a second pulley coaxially coupled to the discharge gear; and a belt connecting the first and second pulleys.

10. The paper feeding mechanism as claimed in claim 3, wherein the rotation power transfer device includes:

a first pulley coaxially coupled to the drive gear;

a second pulley coaxially coupled to the discharge gear; and a belt connecting the first and second pulleys.

11. The paper feeding mechanism as claimed in claim 9, wherein the first and second pulleys comprise timing pulleys, respectively.

12. The paper feeding mechanism as claimed in claim 10, wherein the first and second pulleys comprise timing pulleys, respectively.

13. The paper feeding mechanism as claimed in claim 1, wherein the power transfer unit includes:

a first middle gear meshed with the drive gear, the swing gear clutch being installed between the feed gear and the first middle gear for causing a rotation direction of the drive gear to be constantly maintained in a direction that is adapted to transfer the sheet to the printing zone even though a direction of rotation of the feed gear changes;

a second middle gear meshed with the discharge gear, the rotation power transfer device being adapted to connect the first and second middle gears for causing the discharge gear to rotate in the same direction as the drive gear.

14. The paper feeding mechanism as claimed in claim 13, wherein the swing gear clutch includes:

a swing gear meshed with the feed gear;

a swing arm having a first arm and a second arm and coupled to a shaft of the swing gear;

a first swing gear train coupled to the first arm, said first swing gear train being adapted to transfer a rotation power in the same direction as a direction of rotation of the feed gear; and a second swing gear train coupled to the second arm, said second swing gear train being adapted to transfer a rotation power in a direction reverse to a direction of rotation of the feed gear, such that the swing arm revolves about the shaft of the swing gear based on a rotation direction of the feed gear to selectively utilize one of the first swing gear train and the second swing gear train to rotate the first middle gear.

15. The paper feeding mechanism as claimed in claim 13, wherein the rotation power transfer device includes:

a first pulley coaxially coupled to the first middle gear;

a second pulley coaxially coupled to the second middle gear; and a belt connecting the first and second pulleys.

16. A paper feeding mechanism for an inkjet printer, comprising:

a motor;

a first gear, adapted to be rotated by the motor, the first gear being mounted on a feed roller;

a second gear mounted on a drive roller for transporting paper received from a pickup roller to the feed roller;

a third gear mounted on a discharge roller for discharging paper received from the feed roller;

a swing gear clutch, installed between the first gear and the second gear and adapted to rotate the second gear in a constant direction even though a rotation direction of the-first gear changes; and a rotation power transfer device, adapted to transfer rotational power from the second gear to the third gear.

17. The paper feeding mechanism as claimed in claim 16, wherein the swing gear clutch includes:

a swing gear meshed with the first gear;

a swing arm having a first arm and a second arm and coupled to a shaft of the swing gear;

a first swing gear train coupled to the first arm, said first swing gear train being adapted to transfer a rotation power in the same direction as a direction of rotation of the first gear; and a second swing gear train coupled to the second arm, said second swing gear train being adapted to transfer a rotation power in a direction reverse to a direction of rotation of the second gear, such that the swing arm revolves about the shaft of the swing gear based on a rotation direction of the first gear to selectively utilize one of the first swing gear train and the second swing gear train to rotate the second gear.

18. The paper feeding mechanism as claimed in claim 17, wherein the first swing gear train comprises an odd number of gears.

19. The paper feeding mechanism as claimed in claim 17, wherein the second swing gear train comprises an even number of gears.

20. The paper feeding mechanism as claimed in claim 16, wherein the rotation power transfer device includes:

a first pulley coaxially coupled to the second gear;

a second pulley coaxially coupled to the third gear; and a belt connecting the first and second pulleys.

21. The paper feeding mechanism as claimed in claim 20, wherein the first and second pulleys comprise timing pulleys, respectively.

22. A paper feeding mechanism for an inkjet printer, comprising:

a motor;

a first gear, adapted to be rotated by the motor, the first gear being mounted on a feed roller;

a second gear mounted on a drive roller for transporting paper received from a pickup roller to the feed roller;

a first middle gear meshed with the second gear;

a third gear mounted on a discharge roller for discharging paper received from the feed roller;

a second middle gear meshed with the third gear;

a swing gear clutch, installed between the first gear and the first middle gear and adapted to rotate the first middle gear in a constant direction even though a direction of rotation of the first gear changes; and a rotation power transfer device, adapted to transfer a rotation power of the first middle gear to the second middle gear.

23. The paper feeding mechanism as claimed in claim 22, wherein the swing gear clutch includes:

a swing gear meshed with the first gear;

a swing arm having a first arm and a second arm and coupled to a shaft of the swing gear;

a first swing gear train coupled to the first arm, said first swing gear train being adapted to transfer a rotation power in the same direction as a direction of rotation of the first gear; and a second swing gear train coupled to the second arm, said second swing gear train being adapted to transfer a rotation power in a direction reverse to a direction of rotation of the second gear, such that the swing arm revolves about the shaft of the swing gear based on a rotation direction of the first gear to selectively use one of the first swing gear train and the second swing gear train to rotate the first middle gear.

24. The paper feeding mechanism as claimed in claim 22, wherein the rotation power transfer device includes:

a first pulley coaxially coupled to the first middle gear;

a second pulley coaxially coupled to the second middle gear; and a belt connecting the first and second pulleys.

25. A paper feeding mechanism for an inkjet printer, comprising:

a paper supply cassette, adapted to Store a plurality of sheets of paper;

a pickup roller, installed over the paper supply cassette and adapted to pick up a said sheet;

a drive roller, adapted to move the sheet transferred from the pickup roller toward a printing zone;

a feed roller, adapted to align the sheet transferred from the drive roller;

a discharge roller, adapted to discharge the sheet that has passed through the printing zone;

a drive gear coaxially coupled to a shaft of the drive roller;

a feed gear coaxially coupled to a shaft of the feed roller;

a discharge gear coaxially coupled to a shaft of the discharge roller;

a motor, adapted to supply a rotation power to the shaft of the feed roller;

a first middle gear meshed with the drive gear;

a swing gear clutch installed between the feed gear and the first middle gear for causing the drive roller to be constantly maintained in a direction that is adapted to transfer the sheet to the print zone even though a rotation direction of the feed roller changes and;

a second middle gear meshed with the discharge gear; and a rotation power transfer device, adapted to connect the first middle gear and the second middle gear for causing the discharge roller to rotate in the same direction as the drive roller.

26. The paper feeding mechanism for an inkjet printer as claimed in claim 25, wherein the swing gear clutch includes:

a swing gear meshed with the feed gear;

a swing arm having a first arm and a second arm and coupled to a shaft of the swing gear;

a first swing gear train coupled to the first arm, said first swing gear train being adapted to transfer a rotation power in the same direction as a direction of rotation of the feed gear; and a second swing gear train coupled to the second arm, said second swing gear train being adapted to transfer a rotation power in a direction reverse to a direction of rotation direction of the feed gear, such that the swing arm revolves about the shaft of the swing gear based on a rotation direction of the feed gear to selectively utilize one of the first swing gear train and the second swing gear train to rotate the first middle gear.

27. The paper feeding mechanism as claimed in claim 26, wherein the rotation power transfer device includes:

a first pulley coaxially coupled to the first middle gear;

a second pulley coaxially coupled to the second middle gear; and a belt connecting the first and second pulleys.

* * * * *